US008902121B1

(12) United States Patent
Locker

(10) Patent No.: US 8,902,121 B1
(45) Date of Patent: Dec. 2, 2014

(54) PORTABLE FIELD ANTENNA

(75) Inventor: Sean C. Locker, Dahlgren, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 278 days.

(21) Appl. No.: 13/473,926

(22) Filed: Jun. 20, 2012

(51) Int. Cl.
*H01Q 1/08* (2006.01)
*H01Q 1/12* (2006.01)

(52) U.S. Cl.
CPC ..... *H01Q 1/08* (2013.01); *H01Q 1/1242* (2013.01)
USPC ..... 343/874; 343/875; 343/880; 343/892; 248/156; 248/125.8

(58) Field of Classification Search
CPC ..... H01Q 1/08; H01Q 1/10; H01Q 1/12; H01Q 1/088; H01Q 9/04; H01Q 9/18; H01Q 7/02
USPC ..... 343/874, 875, 878, 880, 881, 890, 892, 343/891, 900; 248/122.1, 125.8, 150, 156, 248/161, 224.7, 177.1, 370; 52/110
See application file for complete search history.

(56) References Cited

U.S. PATENT DOCUMENTS

| | | | | |
|---|---|---|---|---|
| 2,379,577 | A * | 7/1945 | Harsted | 343/900 |
| 3,107,353 | A * | 10/1963 | Fox | 343/881 |
| 3,646,566 | A * | 2/1972 | Neff, Jr. | 343/808 |
| 2009/0267865 | A1 * | 10/2009 | Miller et al. | 343/901 |

FOREIGN PATENT DOCUMENTS

FR 2585886 A1 * 2/1987

* cited by examiner

*Primary Examiner* — Tan Le
(74) *Attorney, Agent, or Firm* — Gerhard W. Thielman, Esq.

(57) ABSTRACT

A portable field antenna platform supports an L-band antenna and communicating via a cable. The platform includes several tubes, a shock cord, and an antenna mount. Each tube has a sleeve and a ferrule inserted therein at a first end of that sleeve. The ferrule of a first tube detachably inserts into a second end of the sleeve of a second adjacent tube. The shock cord passes through each tube to connect all the tubes together by elastic tension. The antenna mount attaches to the antenna and connects a cable to the terminal. The mount includes an antenna connector for connecting the cable to the antenna. The tubes either collapse into a zig-zag bundle in a stow configuration or deploy as a mast.

12 Claims, 5 Drawing Sheets

PORTABLE FIELD ANTENNA

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to the field of radio antennas, and more specifically to portable radio antennas used by military personnel for radio communications in the field Prevailing in a battlefield environment requires maintaining command and control over troops deployed in the field, and this entails ability for those troops to communicate their status and situation back to their commanders. Advances in communication gear currently enable deployed troops to employ a variety of radios with different capabilities, but those radios must be able to send signals that can be received by other communication gear available to commanders. For example, many units of the United States Army and Marine Corps deployed in Iraq and Afghanistan carry radios that are part of the Distributed Tactical Communications System (DTCS). The DTCS radios transmit their communication signals to low-earth orbit Iridium satellites that retransmit those radio communications back to command positions. The DTCS system uses line-of-sight radios that must be positioned where their signals can reach the satellite to complete a successful communication.

Frequently, the antenna that affixed to the DTCS radio is not in position to successfully send the signal to the satellite. That means the radio operator must reposition himself to a location where the radio and its antenna can communicate with the satellite system, which can potentially expose the operator to dangerous conditions. Alternatively, due to terrain or man-made obstructions, sometimes the field unit must connect their radios to a deployed field antenna or field antenna array that can transmit their radio communications to the satellite system.

The current field antenna used by the Army, Marines, and other components of the American military is designated as the OE-254. This consists of several metal tubes that must be connected together and then raised to an upright position. When erected to its 42-foot full height, the OE-254 requires eight guy-lines to securely tie it down so that it does not fall over. Proper deployment of the eight guy-lines requires an open area with a 50-foot diameter, which complicates deployment in restricted areas such as heavy vegetation or crowded urban neighborhoods. Upon deployment, the OE-254 constitutes a static antenna that cannot be relocated without significant disassembly.

The OE-254 has other disadvantages, such as requiring at least two people to set up, and indeed typically needing four to five people. Full assembly takes up to 15 minutes. The OE-254 weighs approximately 50 pounds and stowed in a bag measuring approximately 36"×18"×6" ("" denoting inches), which is too heavy for personnel on foot to carry for any significant distance, particularly in rugged terrain. In addition, the OE-254 is quite visible once deployed, and so provides hostile forces with an indicator of the presence of the unit using it. The OE-254 is also not designed to attach to a building or other objects, which hampers deployment in urban areas.

SUMMARY

There remains an unmet need for a light-weight, easily-assembled field antenna system that can be used in a variety of locations and situations to enhance the communication abilities of military personnel deployed in the field. Conventional portable antennas yield disadvantages addressed by various exemplary embodiments of the present invention. In particular, various exemplary embodiments provide portable field antenna (PFA) platform to support an L-band antenna and facilitate communication via a cable. The PFA platform includes a plurality of tubes, a shock cord, and an antenna mount. Each tube of the plurality has a sleeve and a ferrule inserted therein at a first end of that sleeve. The ferrule of a first tube detachably inserts into a second end of the sleeve of a second adjacent tube. The one-piece shock cord extends the full length of the mast assembly, passing through each tube to connect the plurality of tubes together by elastic tension, starting from a first concatenating terminal to ending at a second concatenating terminal. The antenna mount attaches to the antenna and connects to the first concatenating terminal. The mount includes an antenna connector for connecting the cable to the antenna.

The tubes form one of a zig-zag bundle in a stow configuration and a mast in a deploy configuration. The bundle has the ferrule and sleeve on said adjacent tubes being foldably separate from each other. The mast has the ferrule on the first tube inserted into the sleeve on the adjacent second tube for the plurality of tubes. Other various embodiments alternatively or additionally provide for a hook on the mount for hanging onto an environmental support, and a tip for inserting the end of the mast opposite the antenna into the ground.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

Figure 1:
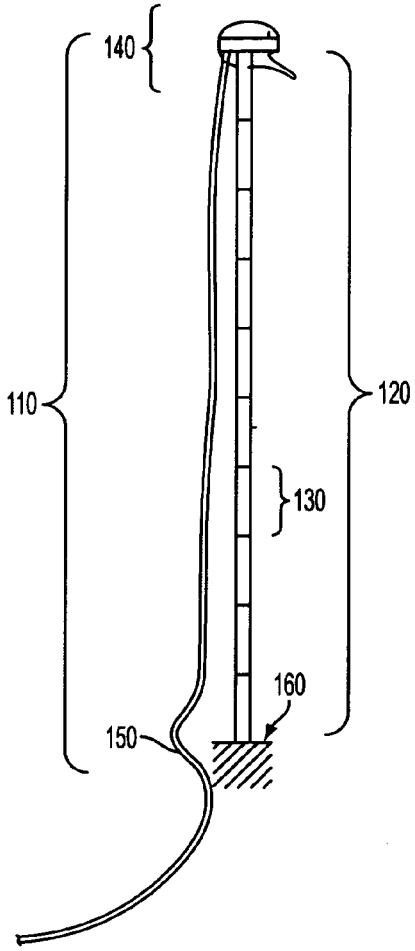
FIG. 1 is an elevation view of a portable field antenna.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

As used herein, the terms are defined as follows:

(a) "antenna" means an electrical device that converts electrical currents into radio waves and radio waves into electric currents;

(b) "armored radio frequency cable" means an electrical cable suitable for transmission of radio frequencies that is protected with an outer sheath made of flexible steel tape, wire armor, or some other material that protects the cable from damage;

(c) "carabiner" is a metal loop with a sprung or screwed gate that is used to quickly and reversibly connect components such as ropes in safety-critical systems;

(d) "elasticized tension component" refers to a shock cord known in the art or any other cord component which exerts a tension force;

(e) "L band" means the portion of the electromagnetic spectrum defined by IEEE as between one and two gigahertz (1-2 GHz) used for GPS and Iridium satellite communication;

(f) "RF cable" means a cable which is structurally adapted to transmit radio frequency (RF) signals;

(g) "selectively attached" means components capable of being attached or detached without compromising structural or mechanical integrity;

(h) "shock cord" means an elastic cord composed of one or more elastic strands forming a core and covered in a sheath made of woven cotton, polypropylene, or other suitable material, with the sheath not materially extending elastically but being braided with its strands spiraling around the core so as to squeeze the core in response to longitudinal tension pulling, transmitting the core's elastic compression to the longitudinal extension of the sheath and cord;

(i) "electrical connector" or "jack" means a plug receptacle that is operatively coupled to a cable component;

(j) "TNC connector plug" means a threaded Neill-Concelman (TNC) connector, which is a type of radio cable connector used in a wide range of radio applications; and (k) "ultra-high-molecular-weight polyethylene (UHMW)" thermoplastic polyethylene characterized by extremely long molecular chains with very high molecular weight, which strengthens the molecular interactions, all materials capable of serving as structural and functional equivalents.

For the purpose of promoting an understanding of the present invention, references are made in the text to exemplary embodiments of a portable field antenna (PFA) platform, only some of which are described herein. It should be understood that no limitations on the scope of the invention are intended by describing these exemplary embodiments. An artisan of ordinary skill will readily appreciate that alternate, but functionally equivalent materials, components, and configurations may be used, together with the inclusion of additional elements that may be deemed readily apparent. Specific elements disclosed herein are not to be interpreted as limiting, but rather as a basis for the claims and as a representative basis for teaching the artisan to employ the present invention. It should be understood that the drawings are not necessarily to scale; instead, emphasis has been placed upon illustrating the principles of the invention. Moreover, the terms "substantially" or "approximately" as used herein may be applied to modify any quantitative representation that could permissibly vary without resulting in a change in the basic function to which it is related.

FIG. 1 presents an elevation view 100 of an exemplary embodiment of the components of a portable field antenna (PFA) system 110. In the embodiment shown, a rigid pole or mast is 120 is comprised of a concatenated plurality of hollow tubular segments or tubes 130 secured by an elasticized tension component in the deploy configuration.

The tubes 130 can be composed of any light-weight rigid material that supports the antenna and components on top of the mast 120 with minimal electrical interference. The tubes 130 are preferably made from carbon fiber with annular cross-sections, although alternate geometries can be contemplated without departing from the scope of the invention. In the configuration depicted, each tube 130 has dimensions of Ø0.625" outside diameter by Ø0.50" inside diameter and with a length of 12". The PFA 110 employs carbon fiber tubing for its mast 120 to be very lightweight, extremely strong, and easy to set up. Being shock-corded together, the tubes 130 slip inside each other, and so the mast 120 reaches full length in a few seconds. By using carbon fiber, the tube diameters remain consistent regardless of the temperature that an operator may encounter in the field, as well as being light-weight for improved portability.

In the exemplary embodiment shown, the PFA 110 supports an antenna assembly 140 with an L-band antenna for communicating with the Iridium communication satellite system and the Global Positioning System (GPS). The antenna assembly 140 may alternatively or additionally include auxiliary or multiple antennas to enhance communications of very-high-frequency/ultra-high-frequency (VHF/UHF) radios or to provide redundancy in even of failure of a single antenna or signal receiving device. In alternative embodiments, the antenna assembly 140 may include sensing or recording equipment.

In the embodiment shown, the antenna assembly 140 with the antenna assembly is affixed to the mast 120, and a radio frequency (RF) cable 150 attaches via an RF cable connector plug on the underside of antenna assembly at the antenna assembly 140. The distal end of the cable 150 connects to a radio of the unit deploying the PFA 110. In the exemplary embodiment shown, the cable 150 is a twenty-foot (20') long armored RF cable suitable for use by the military operating in the field. In other exemplary embodiments, cable 150 may be longer or shorter than 20'. Depending on the number of tubes 130, the mast 120 can be raised to a variety of discrete vertical heights, with the example shown representing 10' from ground level 160.

Figure 2:
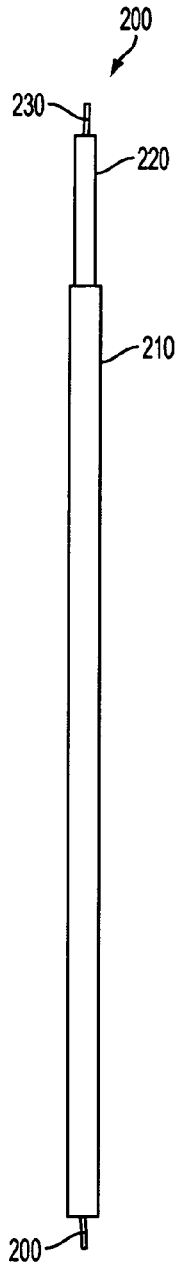
FIG. 2 is an elevation view of a hollow tube that forms a mast.
Figure 3:
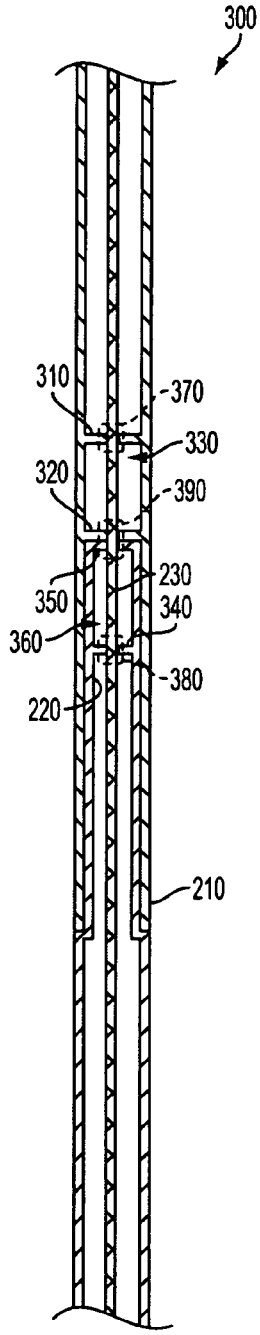
FIG. 3 is an elevation cross-section view of the hollow tube.

FIG. 2 presents an elevation view 200 of an exemplary embodiment of the tube 130. An external sleeve 210 connects to an internal ferrule 220 with elastic tension cords 230 extending from their terminal ends. FIG. 3 illustrates an elevation cross-section view 300 of a pair of tubes 130 connecting together. In the embodiment shown, the outer sleeve 210 includes an upper interior bulkhead 310 and a terminal bulkhead 320 that define a cylindrical cavity 330. The inner shaft 220 includes an interior bulkhead 340 and a terminal bulkhead 350 that define a lower cylindrical cavity 360. The proximal bulkheads 310 and 340 have axial orifices shown within respective envelopes 370 and 380. Similarly, the terminal bulkheads 320 and 350 have axial orifices within envelope 390. The tension cord 230 passes through these orifices and extend to the adjacent tube 130. The tension cord 230 anchors by knots at opposite ends of the assembly of tubes 130 that connect together to form the mast 120.

Each hollow carbon fiber tube 130 includes the sleeve 210 having an annular cross-section with a 0.625 inch (") outside diameter by 00.5" inside diameter and a length of 12" or 1 foot (). The ferrule 220, with an outside diameter of Ø0.495" and 5" length, is bonded to the inside of the 12" sleeve 210, with half of the ferrule 220 protruding out the top of the sleeve 210, thereby forming the tube 130. The exposed portion of the ferrule 220 at the top of one sleeve 220 slides into the bottom of the next 12" sleeve 210. The 0.005" difference in outer diameter of the ferrule 220 and inner diameter of the 12" sleeve 210 combined with the elasticity of the shock cord 230 creates a connection that quickly slips together into the mast 120.

In the embodiment shown, the elastic tension cord 230 secures one end of each hollow tube 130 to its adjacent counterpart. In the embodiment shown, the elastic tension cord 230 represents flexible connector shock line known in the art which secures the axially aligned tubes 130. The exemplary shock cord 230 has diameter Ø0.1875" with length of 10' to connect together all of the tubes 130 that form the mast 120. The shock cord 230 has flexibility to bend when collapsing the tubes 130 in zig-zag fashion as a bundle for stowage or transport. The shock cord 230 imposes sufficient tensile force to align and force the ferrule 230 to insert into the adjacent sleeve 220 for rapid assembly into the mast 120. Various quantities of hollow tubes 130 may be assembled, with ten being shown in the elevation view 100, although the height of the mast 120 can be varied by the number of concatenated tubes 130. The PFA 110 is designed for rapid assembly and disassembly. Moreover, the PFA 110 can be carried to another location, even with the mast 120 assembled, while still connected to radio communication devices, and therefore remain fully operational during transit.

Figure 4:
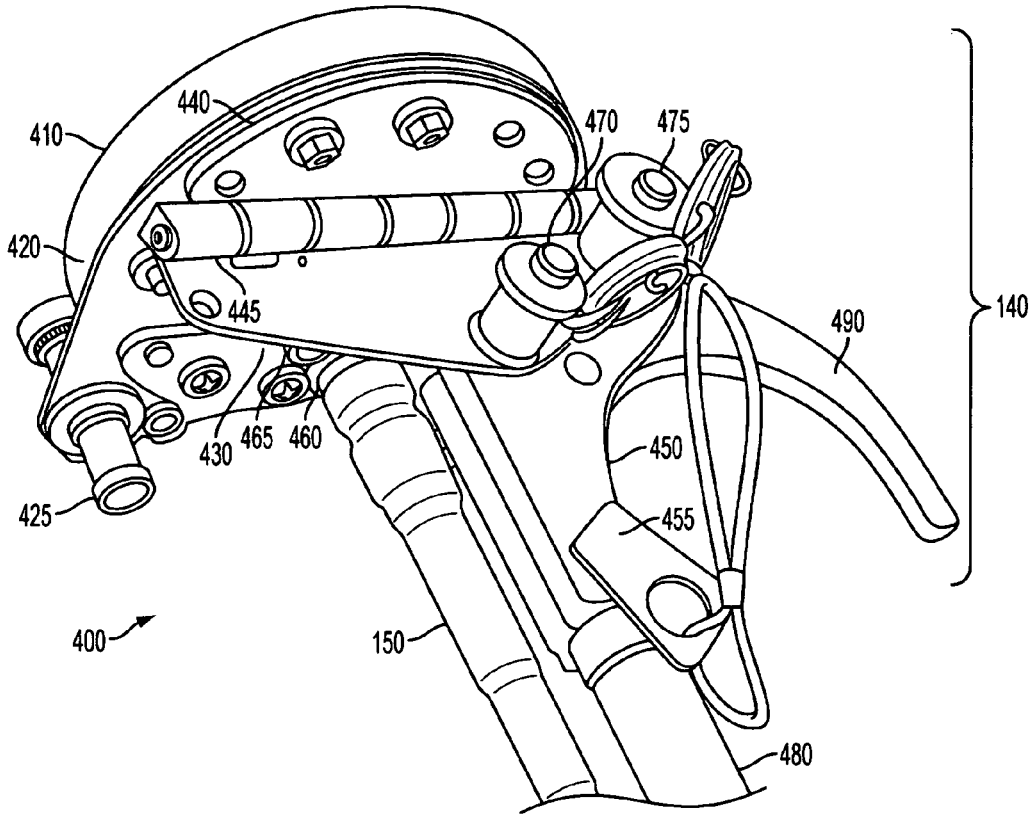
FIG. 4 is a perspective detail view of an antenna assembly.

FIG. 4 shows a perspective view 400 (from below) of the antenna equipment assembly 140, which includes a dome antenna 410 for GPS and Iridium communication. The passive L1 dome antenna 410, with an outer diameter of Ø3.5" and a dome height of 0.66", is available under Part No. 3G15P-XS-1 from Antcom® Corporation of Torrance, Calif. The dome antenna 410 weighs 7 oz and is composed of 6060-T6 aluminum and thermoset plastic, and covered with Skydrol-resistant enamel for protection from external weather exposure. The dome antenna 410 is disposed on a bracket 420, having an auxiliary antenna connector 425, which enables communication in the L-Band, GPS, and includes TNC connector jacks for the cable 150. Artisans of ordinary skill can note that a PFA platform can represent the PFA system 110 sans the dome antenna 410.

A vertical plate 430 supports a lateral plate 440 onto which the bracket 420 mounts. The horizontal plate 440 pivots relative to the vertical plate 430 by a hinge 445 for roll angle adjustment. The plate 430 connects to a mount bracket 450, and includes a nut 455 to serve as a lanyard tie nib. The cable 150 terminates in an RF plug 460. The bracket 420 includes an RF connector 465 into which the plug 460 can be inserted. Quick-release push-pins 470 and 475 insert into aligned holes in the vertical plate 430 and the mount bracket 450 to enable the vertical plate 430 and thereby the antenna 410 to adjust in pitch angle. The mount bracket 450 further includes a rod 480 that connects to the mast 120 and a hook 490 for hanging from an environmental support, such as a roof structure or tree branch. The hook 490 enables suspending the mast 120 to achieve varied heights and facilitate antenna operation in a variety of conditions and terrains.

The dome bracket 420 and the vertical plate 430 contain apertures or slots into which the quick-release pin 470 (or any other securing member known in the art) may be inserted to join them together. The hinge 445 enables adjustment of the angle of antenna assembly 140 for optimum orientation for radio performance. Upon determining the best position, the position of antenna assembly 140 can be locked in place with the quick-release push-pin 475 (or similar component). The RF cable 150 connects to the antenna assembly 140 by inserting the RF cable connector plug 460 into the antenna connector 465. In the exemplary embodiment shown, RF cable connector plug 460 is a TNC connector plug and RF cable connector 465 is a TNC jack. The underside of the dome bracket 420 also includes the RF cable connector 425, which enables connection of a second RF cable to antenna assembly 140 for wireless communication.

Figure 5:
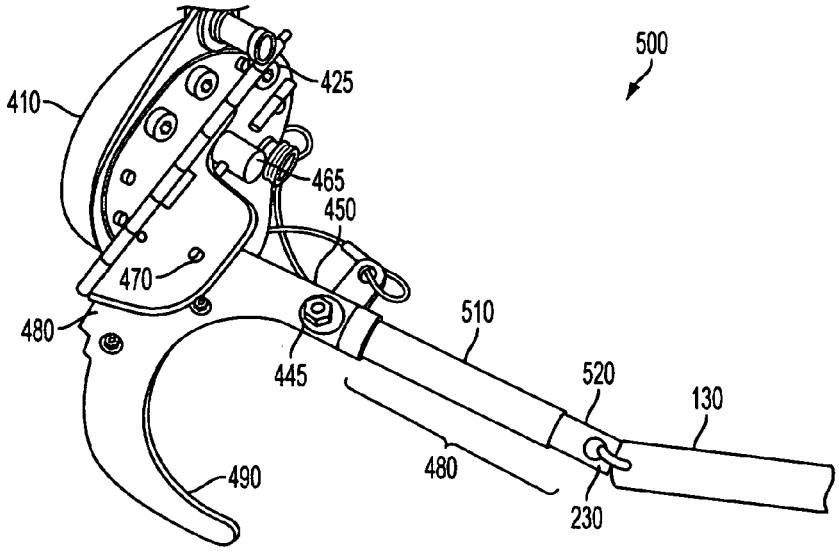
FIG. 5 is a perspective detail view of the PFA's top end.
Figure 6:
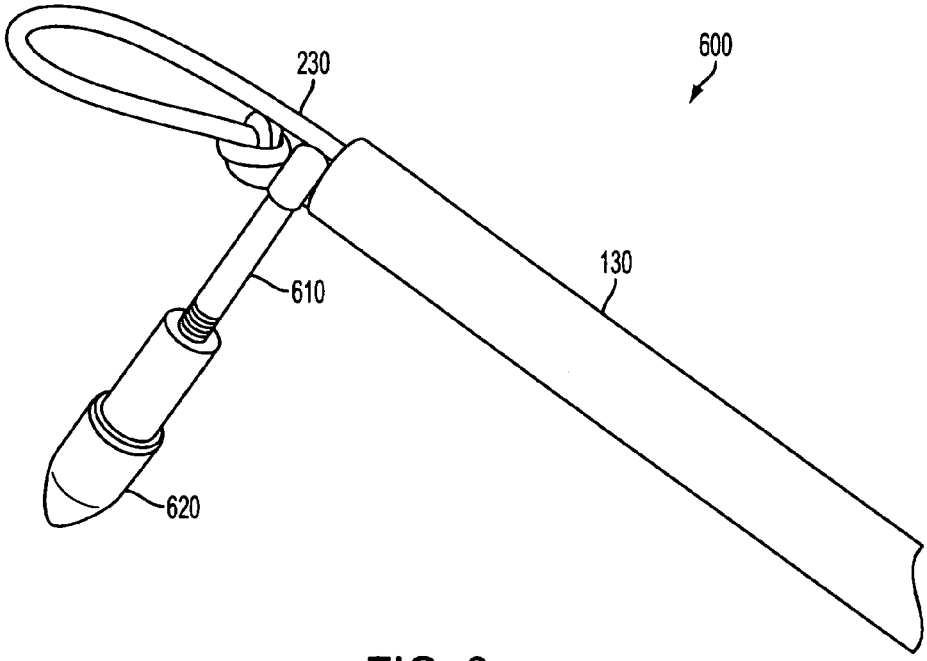
FIG. 6 is a perspective detail view of the mast's bottom end.

FIG. 5 shows a perspective view 500 of the antenna equipment assembly 140 with an upper portion of the mast 120. The rod 480 includes a shaft 510 and a flat end 510 that aligns with the nearest tube 130. The shock cord 230 terminates at a hole in the flat end 510 to secure the rod 480 to the mast 120. FIG. 6 shows a perspective view 600 of the lower portion of the mast 120. The shock cord 230 passes through a stud 610 terminating in a knot. The stud 610 connects to a bullet-shaped tip 620. Upon deployment, the stud 610 inserts into the tube 130, secured by a releasable restraint such as a set-screw, with the tip 620 extending out of the tube 130. The tip 620 can be inserted into the ground 160 for vertical stability of the mast 120 upon deployment upright.

Figure 7:
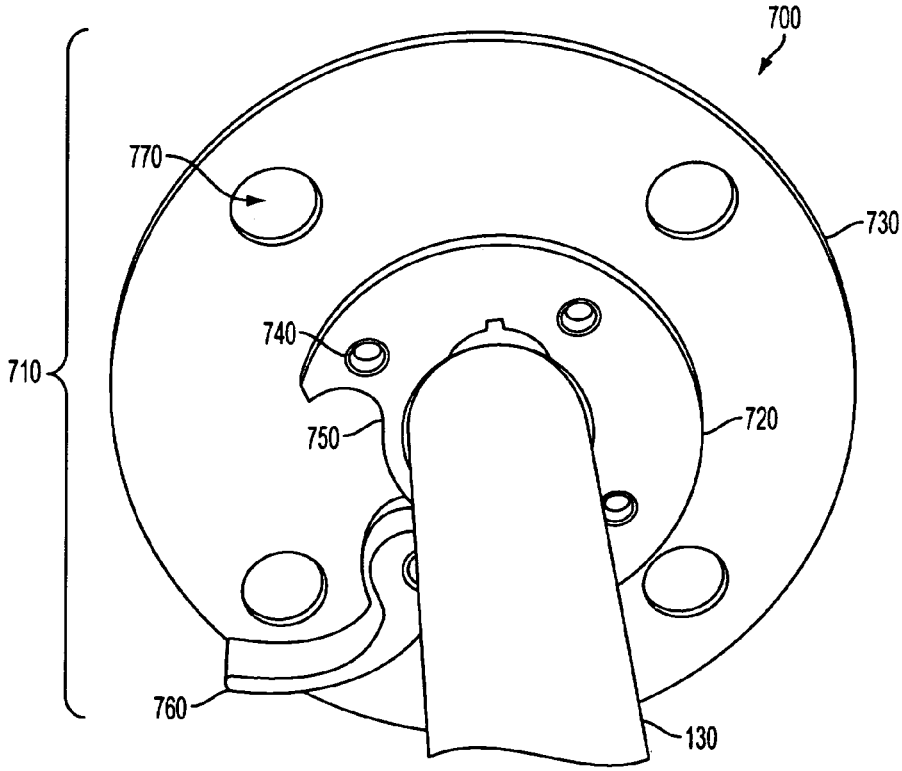
FIG. 7 is a perspective detail view of a shaft collar.

FIG. 7 shows a perspective view 700 (viewed from the bottom) of a shaft collar 710 for anchoring the mast 120. The collar 710 includes an inner split-ring 720 and an outer disk flange 730, secured to each other by rivets 740. The split-ring 720 includes a receptacle section 750 connected to the split-ring (not shown) and tightened around the tube 130 by a locking lever 760 after the collar 710 has slid along the mast 120 to a desired position.

The tubes 130 that comprise the mast 120 need not be uniform as long as the top of the ferrule 230 can slide into the bottom of the sleeve 220 directly adjacent. Alternatively, the PFA 110 could be assembled from telescoping tubes, at a cost of likely increase the size and weight of the system. The exemplary tubes 130 could optionally be secured with pins, but these are not necessary and add weight to the system with increase in assembly time. Opposite the antenna assembly 140, the PFA 110 optionally includes the tapered, bullet shaped end-piece 620 made of 6061 aluminum in order to prevent damage to the end carbon fiber tube 130 when driving the mast 120 into the ground 160. The bullet-shaped tip 620 can be secured to the mast 120 with a #6-32 set-screw. Detachable fold out legs for a tripod system can be used to augment stability in the installed upright position.

Figure 8:
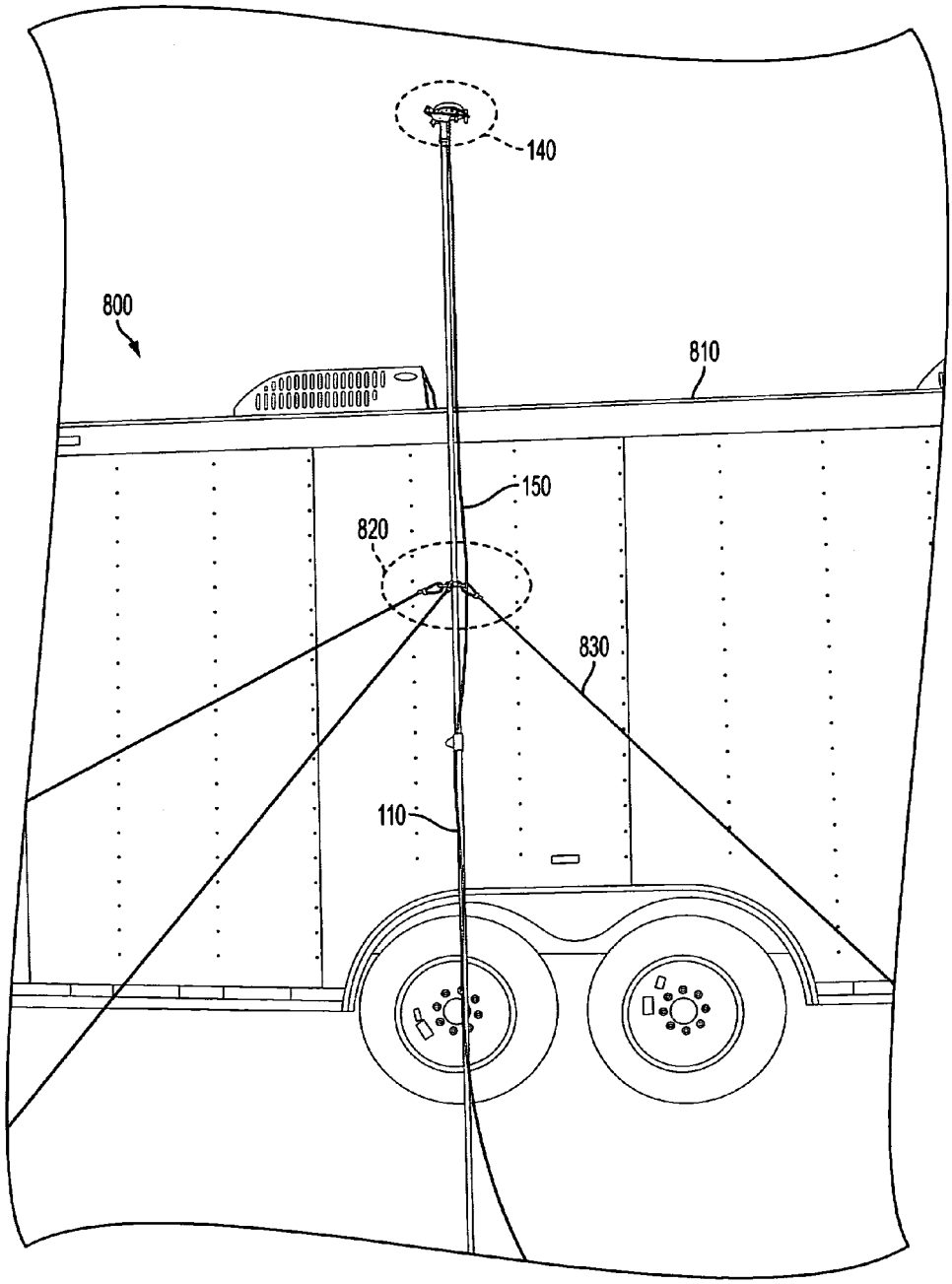
FIG. 8 is a perspective view of the PFA erected in the field.

FIG. 8 shows a perspective view 800 of an upper portion of the assembled PFA 110 shown against a trailer 810 for scale. The antenna equipment 140 mounted atop the mast 120, along with a shaft collar assembly 820 that connect to guy lines 830 for ground stability. The assembly 820 includes the shaft collar 710 together with carabiners that secure the guy lines 830. During transport of the PMA 110, the mast 120 would be held upright so that staking the guy lines 830 would be optional under such conditions.

Figure 9:
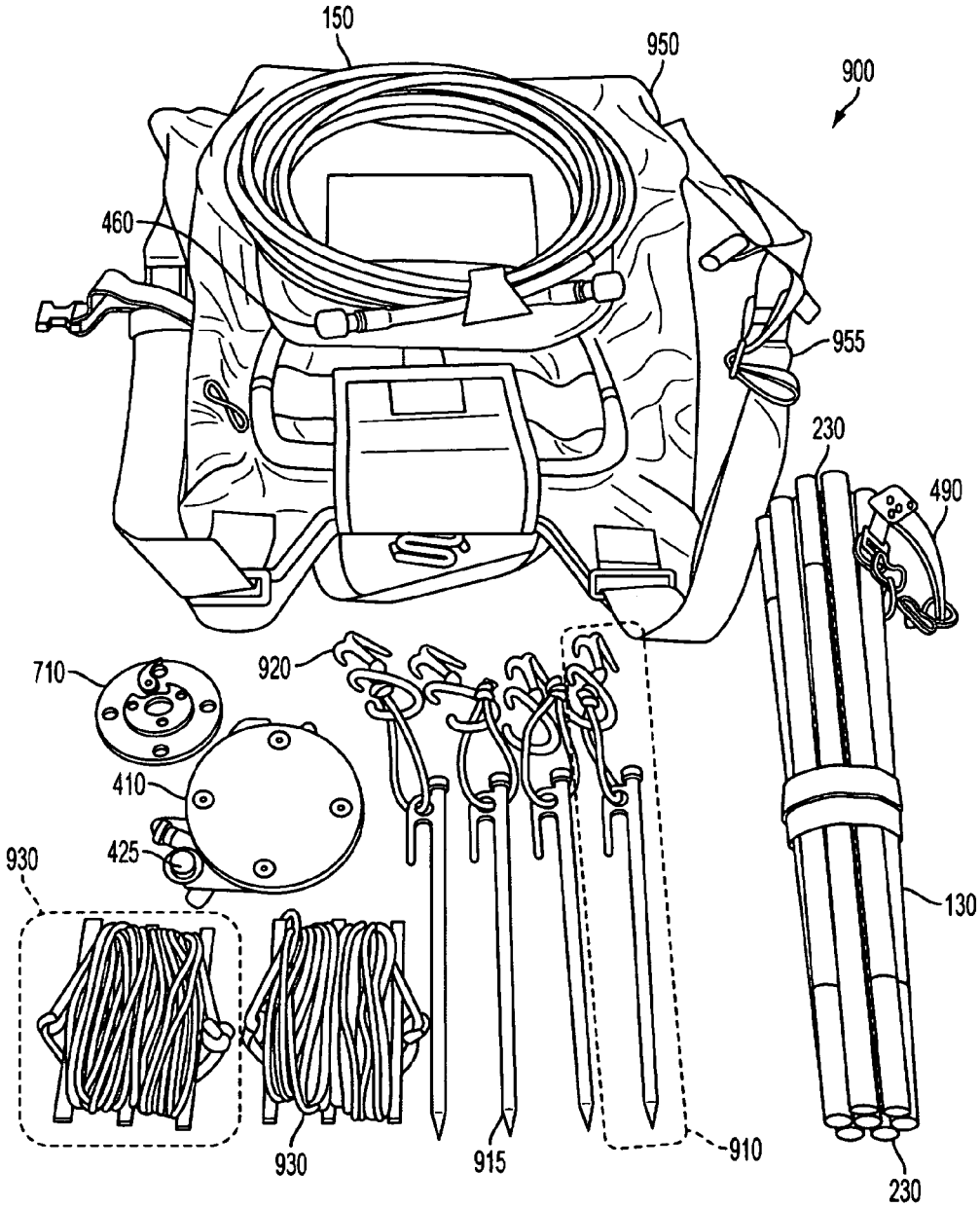
FIG. 9 is a perspective view of components that comprise the PFA.

FIG. 9 shows a perspective view 900 of disassembled equipment that comprises the PFA 110. The guy lines 830 connect from the collar assembly 820 to anchor assemblies 910, each of which includes a tent stake 915 and a carabiner 920 connected together by flexible rope. The tent stakes 915 are designed for insertion into the ground 160 to provide tension to the guy lines 830 when erecting the mast 120. Example carabiners 920 include designs from Nite-Ize® as tie-downs. The tubes 130 are disassembled in the stow configuration. The shaft collar 710 secures the assembly 820 to the mast 120 and provides a base from which to tie the guy lines 830 (shown spooled in polyurethane plates) leading to the anchors 910. A backpack 950 provides the light-weight container in which to carry the PFA 110 components. The backpack 950 includes shoulder straps 955 for wearing. The view 900 shows the cable 150 coiled (in this example an armored Megaphase model), terminating at the TNC plugs 460.

In the embodiment of the PFA 110 shown in assembly view 800, the shaft collar 710 slides onto to antenna mast 120 for positioning about three-quarters of the distance from the ground 160 up to the antenna assembly 140, and secured by a locking lever 760. Once in place, the shaft collar 710 provides attachment through-holes for guy lines 830 to hold the mast 120 erect. For installation, the tent stakes 915 are pounded into the ground and attached to the guy lines 830 with the carabiners 920. For installation, the antenna mast 120 is erected to vertically upright, and the guy lines 830 are tightened sufficiently to secure the PFA 110 to the upright position.

The PFA 110 can be disassembled by releasing the guy lines 830 lower the mast 120 and then removing the antenna assembly 140 from the antenna assembly 140. The hollow tubes 130 that form the antenna mast 120 are then secured in a compact bundle by a restraining band, and all of the disassembled pieces, including the shaft collar 710, guy lines 830, and tent stakes 915, can be placed in the backpack 950 for transport by a single person on foot.

The PFA 110 was developed to meet several capability gaps: first, to augment the Distributed tactical Communications System (DTCS) radios, helping tactical or forward deployed units by its compact size, portability, and ease of use. The PFA 110 enables war-fighters, snipers being a prime example, to maintain cover and concealment while still fulfilling their mission. For instance, in an urban environment, buildings can be used to provide cover and concealment from the enemy, but this compromises RF communications due to signal blockage, and frequently renders satellite communications impossible. Exemplary embodiments enable the antenna assembly 140 to be attached directly to the top of the mast 120 and with the operator tethered to the radio, and thus the antenna through an audio handset or headset. The PFA 110 enables the antenna to be mounted in a location where the war-fighter can maximize the communication performance while remaining concealed, maintaining their radio at their side while running the cable 150 to the mast 120 and antenna assembly 140 just above the roofline. This enables SATCOM line-of-sight radios such as DTCS to maintain a link with a communication satellite. Or, if the war-fighter is using a VHF/UHF radio such as a PRC-148 MBITR or PRC-152 Falcon III, an omni-directional antenna out of the building and into open air facilitates better communication to avoid obstruction of the radiation pattern, as would occur if the antenna was still in the building. In addition, the hook 490 at the end of the mast 120 enables the war-fighter to hang the PFA 110 to a height of 10' in the air from wherever their hands reach, approximately 17' high for the average man. This can be accomplished in a minute or two, being desirable for a military unit on the move in an "urban canyon" that is trying to communicate with others but may not be able to due to the height of surrounding buildings.

On the opposite end of the environmental spectrum, the PFA 110 also benefits a war-fighter operating in dense foliage or in mountainous terrain. Frequently, operations in those terrains hamper RF communication. For example, in Afghanistan, for a patrol using existing VHF/UHF radios may only be able to talk several miles back to their base camp due to hills or mountains. While the PFA system 110 cannot overcome all issues stemming from terrain obstruction, its benefit can be valuable. For example, DTCS radios, of which thousands have been or remain in use in Operation Enduring Freedom (OEF) and Operation Iraqi Freedom (OIF), use the Iridium constellation of low-earth orbit satellites. Iridium satellites spend approximately 80% of their time on the lowest 20% of the horizon. Because the PFA 110 enables a war-fighter to elevate the antenna 10', or 17' or more if hooked to a tree branch or building, the design greatly increases the time that the war-fighter can maintain the link to the satellite. Although existing VHF/UHF radios like the PRC-148 don't communicate with satellites, a war-fighter can also increase the communications reliability of those radios by using the PFA 110.

Capt. Matkins USMC was embedded with 2$^{nd}$ Battalion/3$^{rd}$ Marines —Golf Company during a four-day exercise in July, 2010. He reports from a field exercise for the PFA 110 (denoted as man-portable field antenna or MPFA): "Setting up the MPFA is very easy. It can be done with one person in a minute or two. Remove the necessary components from the carry pack, example, if you're not tying it down with the guy lines, you won't need them or the quick release shaft collar. Undo the band that bundles the mast together. Deploy the mast and let the shock cord do its work, just like a set of tent poles. Take the antenna bracket and secure it to the top of the mast/hook with the quick release push pin. Undo the band that holds the RF cable in a loop. Connect it to the DTCS antenna or the TNC-TNC adapter if you wish to utilize another antenna (that has a TNC plug). Now connect the cable to your radio. If you wish to utilize it as a stand-alone mast, these are the additional steps. Remove the tent stakes, guy lines, and quick release shaft collar from the bag. While holding the mast, align the notch in the shaft collar with the screw at the bottom of the mast. Slide the collar up about three-quarters the length of the mast, turn the lever to tighten and secure it. Place tent stakes into desired location and drive them into the ground. Take guy lines and using the carabiners at the end of the line, clip them to the shaft collar. Take the other end of the guy lines and wrap them around the special quick tie 'FIG. 9' carabiners."

The PFA 110 can be used in any length, in 1' increments, up to 10' (in the embodiments shown) by linking selected numbers of tubes 130. The PFA 110 also has the ability to articulate (i.e., pivot) its antenna assembly 140 in pitch and roll. One quick release push-pin 470 positions the antenna bracket 420 on the mast assembly 120, while the second pin 475 enables the angle of the dome bracket 420 to be adjusted, such as for example, if the hook 490 is used to hang the mast 120 from a tree branch or building, the dome bracket 420 may be canted at an angle, if the antenna assembly 140 loses its optimum orientation with the sky. The pin 470 can be pulled out to adjust the antenna equipment 410 to another position to improve radio performance.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A portable field antenna (PFA) platform for supporting an L-band antenna and communicating via a cable, said platform comprising:

a plurality of tubes, each tube having a sleeve and a ferrule inserted therein at a first end of said sleeve, wherein said ferrule of a first tube detachably inserts into a second end of said sleeve of a second adjacent tube;

a shock cord that passes through each said tube to connect said plurality of tubes together from a first concatenating terminal to a second concatenating terminal by elastic tension; and an antenna mount that attaches to the antenna and connects to said first concatenating terminal, said mount including:

an antenna connector for connecting the cable to the antenna, a bracket for the antenna, a flange that connects to said shock cord, a vertical plate that connects to said flange, and a hinge that pivotably connects said bracket to said plate for roll adjustment of said mount to said mast, wherein said plurality of tubes forms one of a zig-zag bundle in a stow configuration with said ferrule and said sleeve on said adjacent tubes being foldably separate from each other, and a mast in a deploy configuration having said ferrule on said first tube being inserted into said sleeve on said adjacent second tube for said plurality of tubes.

2. The platform according to claim 1, wherein each said tube is composed of carbon fiber.

3. The platform according to claim 1, further comprising a tip at said second concatenating terminal, said tip being insertable into ground.

4. The platform according to claim 1, wherein said mount further includes a hook.

5. The platform according to claim 1, wherein said mount further includes an auxiliary antenna connector for radio communication.

6. The platform according to claim 1, further including a pin connector on said flange to pivot said plate for pitch adjustment of said mount to said mast.

7. A portable field antenna (PFA) system for supporting an antenna and communicating with a transceiver, said system comprising:

a plurality of tubes, each tube having a sleeve and a ferrule inserted therein at a first end of said sleeve, wherein said ferrule of a first tube detachably inserts into a second end of said sleeve of a second adjacent tube;

a shock cord that passes through each said tube to connect said plurality of tubes together from a first concatenating terminal to a second concatenating terminal by elastic tension;

an L-band dome antenna for satellite communication;

a cable for electromagnetic signal communication between the transceiver and said dome antenna; and an antenna mount that attaches to said dome antenna and connects to said first concatenating terminal, said mount including:

an antenna connector for connecting said cable to said dome antenna, a bracket for said antenna, a flange that connects to said shock cord, a vertical plate that connects to said flange, and a hinge that pivotably connects said bracket to said plate for roll adjustment of said mount to said mast, wherein said plurality of tubes forms one of a zig-zag bundle in a stow configuration with said ferrule and said sleeve on said adjacent tubes being foldably separate from each other, and a mast in a deploy configuration having said ferrule on said first tube being inserted into said sleeve on said adjacent second tube for said plurality of tubes.

8. The system according to claim 7, wherein each said tube is composed of carbon fiber.

9. The system according to claim 7, further comprising a tip at said second concatenating terminal, said tip being insertable into ground.

10. The system according to claim 7, wherein said mount further includes a hook.

11. The system according to claim 7, wherein said mount further includes an auxiliary antenna connector for radio communication via said cable.

12. The platform according to claim 7, further including a pin connector on said flange to pivot said plate for pitch adjustment of said mount to said mast.

* * * * *